United States Patent [19]

Unnai et al.

[11] Patent Number: 4,816,715

[45] Date of Patent: Mar. 28, 1989

[54] IMAGE PICK-UP TUBE TARGET

[75] Inventors: Takaaki Unnai; Yasuhiko Nonaka; Eisuke Inoue, all of Mobara, Japan

[73] Assignee: Hitachi, Ltd., Tokyo, Japan

[21] Appl. No.: 71,308

[22] Filed: Jul. 9, 1987

[30] Foreign Application Priority Data

Jul. 11, 1986 [JP] Japan ..... 61-16805

[51] Int. Cl.[4] ..... H01J 31/38

[52] U.S. Cl. ..... 313/366; 313/386

[58] Field of Search ..... 313/386, 366

[56] References Cited

U.S. PATENT DOCUMENTS

| | | | |
|---|---|---|---|
| 4,307,319 | 12/1981 | Terao et al. | 313/386 |
| 4,463,279 | 7/1984 | Shidara et al. | 313/386 |
| 4,563,611 | 1/1986 | Nonaka et al. | 313/386 X |
| 4,587,456 | 5/1986 | Inoue et al. | 313/386 X |

*Primary Examiner*—Palmer C. DeMeo

*Attorney, Agent, or Firm*—Antonelli, Terry & Wands

[57] ABSTRACT

There is disclosed an image pick-up tube target comprising an N-type conductive film formed on a transparent substrate, and a P-type photoconductive film in rectifying contact with the N-type conductive film and comprising a first layer containing As and Se, the average concentration of As in the first layer being below 8% by weight, a second layer containing As and Se, a third layer containing As and Se, the concentration of As being in the range of 8 to 20% by weight and thickness of the third layer being in the range of 5 to 50% of the total thickness of the P-type photoconductive film, in the order named, and a beam landing layer.

6 Claims, 3 Drawing Sheets

IMAGE PICK-UP TUBE TARGET

BACKGROUND OF THE INVENTION

This invention relates to an image pick-up tube target and, more particularly to an improved structure of a rectifying contact type image pick-up tube target comprising a P-type photoconductive layer containing Se as a major constituent, and also As and Te or other materials and a beam landing layer, featuring little variation in signal current-target voltage characteristic during a long term operation.

A photoconductive image pick-up tube target utilizing a rectifying contact between a P-type photoconductive layer comprising amorphous Se, Te, As and other materials and N-type material is disclosed in U.S. Pat. Nos. 3,890,525, 3,922,579, 3,984,722, 4,040,985, and 4,330,733.

The advantages of an image pick-up tube target of this type are high speed response, little image flare, high resolution and ease of manufacture.

FIG. 1 shows a section of a main part of an image pick-up tube target. A transparent conductive film 2 containing $SnO_2$ or $In_2O_3$ as a major constituent is formed on the rear surface of a transparent glass substrate 1. A very thin N-type transparent conductive film 3 of zinc selenide, germanium oxide, cerium oxide, lithium fluoride or the like is formed on the rear surface of the transparent conductive film 2. A P-type photoconductive film 14 of several microns in thickness containing amorphous Se as a major constituent is deposited on the N-type transparent conductive film 3 to form a rectifying contact with the N-type conductive film 3. A beam landing layer 5 of $Sb_2S_3$ or the like is deposited to be about 1000 Å thick on the P-type photoconductive layer 14.

Incident light 6 from a scene enters the transparent glass substrate 1 and a scanning beam 7 lands on the $Sb_2S_3$ layer 5 to convert the light image into electrical signals.

Since Se is not sensitive to long wavelength radiation, it has been proposed to add Te into a portion of several hundreds Å in thickness near the rectifying contact of the Se-containing layer 14 with a peak concentration of 20 to 50% by weight in order to improve the sensitivity to long wavelength radiation. This method is disclosed in U.S. Pat. Nos. 3,890,525 and 4,040,985.

The amorphous photoconductive layer 14 with Se as a main component is easily crystallized by heat, resulting in appearance of white dots in a reproduced picture. As is doped throughout the P-type photoconductive layer 14 in order to increase the viscosity and to decrease the speed of crystallization. In this case, the P-type photoconductive layer 14 is formed by evaporation of a compound containing a predetermined amount of Se and As, or by alternate evaporation of thin layers less than 100 Å of Se and $As_2Se_3$ as disclosed in U.S. Pat. No. 3,800,194.

An image pick-up tube target of the aforementioned conventional type leaves much to be desired in terms of sensitivity- and sensitivity saturation-target voltage characteristics and suppression of dark current. A poor sensitivity saturation characteristic requires a higher target voltage to be applied, and increase in dark current results in degradation of a reproduced picture.

U.S. Pat. No. 4,219,831 discloses a method to improve sensitivity- and sensitivity saturation-target voltage characteristics and to suppress dark current by limiting a whole amount of As doped into the P-type photoconductive layer in a range between 2.5 and 6% by weight.

Japanese Patent Publication (Kokoku) No. SHO. 57-44030 discloses a method to prevent cracking of a beam landing layer made of $Sb_2S_3$ due to rapid temperature changes or operation under high temperature conditions by doping As of 10 to 20% by weight in the region of the P-type photoconductive layer of about the same thickness as that of the beam landing layer of $Sb_2S_3$ and adjacent to the beam landing layer.

However, the aforementioned conventional image pick-up tube targets had signal current-target voltage characteristics varied during a long term continuous operation due to changes in internal electric field within the target, resulting in deterioration of picture quality.

It has been one of the demands by TV camera users to improve the signal current-target voltage characteristic for the purpose of reproduction of higher quality pictures.

SUMMARY OF THE INVENTION

It is, therefore, an object of the present invention to provide an image pick-up tube target capable of eliminating variations in signal current-target voltage characteristic during a long term continuous operation.

The above mentioned object can be accomplished by the present invention which provides an image pick-up tube target comprising an N-type conductive film formed on a transparent substrate, and a P-type photoconductive film in rectifying contact with the N-type conductive film and comprising a first layer containing As and Se, the average concentration of As in the first layer being below 8% by weight, a second layer containing As and Se, a third layer containing As and Se, the concentration of As being in the range of 8 to 20% by weight and the thickness of the third layer being in the range of 5 to 50% of the total thickness of the P-type photoconductive film, in the order named, and a beam landing layer.

DETAILED DESCRIPTION OF THE PREFERRED EMBODIMENTS

The function of As doped in the amorphous Se photoconductive layer is as explained before, and by increasing an amount of doped As cracking of a beam landing layer made of $Sb_2S_3$ is prevented because viscosity of an amorphous Se photoconductive layer is increased and the speed of its crystallization is decreased and the coefficient of thermal expansion of the amorphous layer is lowered.

However, the present inventors have found that increasing of the concentration of As throughout the entire amorphous Se layer increases dark current in an image pick-up tube target. Doped As functions as traps for carriers generated by incident light, and captured electrons modify internal electric field in the amorphous Se layer, and the electric field especially in the region containing Te as a sensitizer is strong enough for positive holes to be easily injected from the N-type conductive layer, resulting in increase in dark current.

It was found that dark current is within an accebtable value if the average amount of As doped in the region of a P-type photoconductive layer ranging from the rear surface of an N-type conductive film to 3000 Å is below 8%, preferably 2.5 to 6% by weight.

Figure 1:
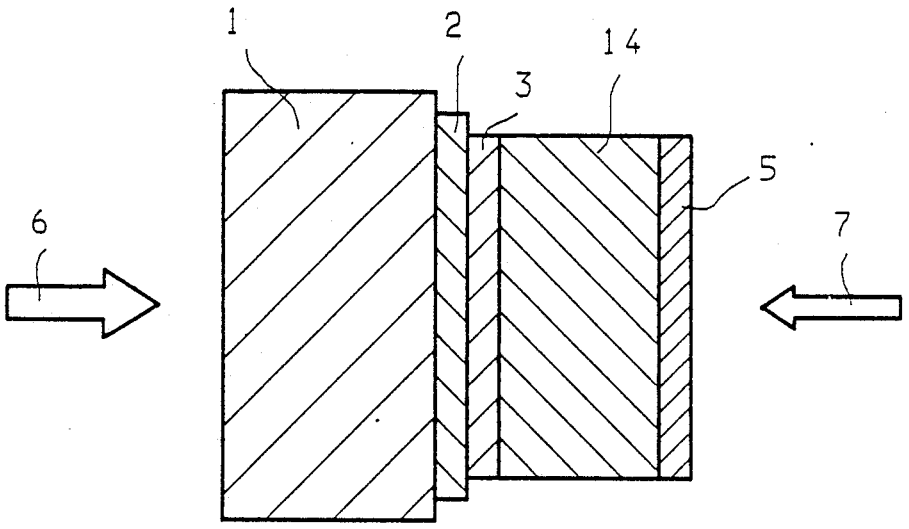
FIG. 1 shows a sectional view of a target used in an image pick-up tube target.
Figure 2:
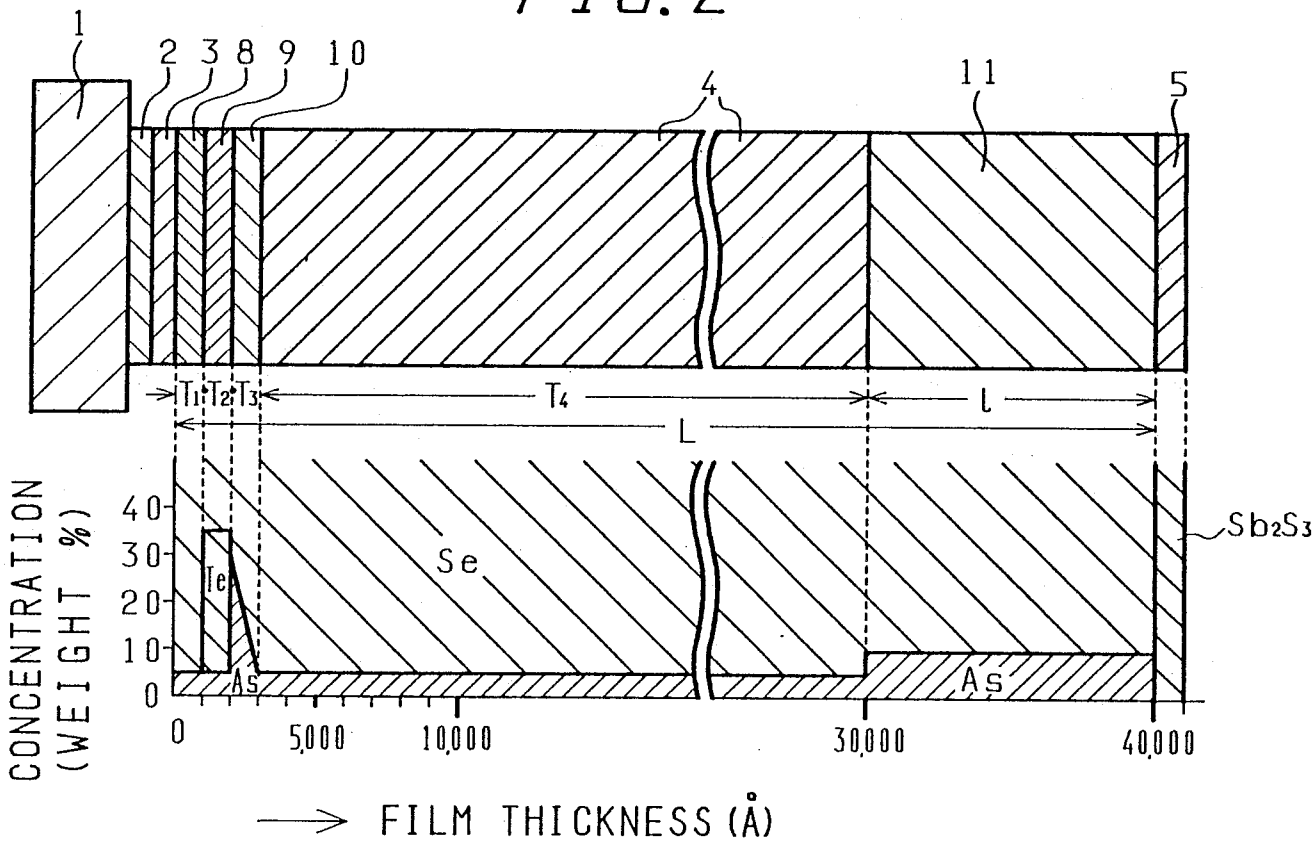
FIG. 2 illustrates a schematic view, in section and not to scale, along with a concentration distribution diagram, showing one embodiment of the image pick-up tube target according to the invention.

FIG. 2 illustrates a sectional view, along with a concentration distribution diagram, showing one embodiment of the image pick-up tube target according to the invention. The same reference numerals as in FIG. 1 denote the same parts as in FIG. 1, and a detailed description thereof will be omitted.

A transparent electrode 2 mainly composed of, for instance, $SnO_2$ is formed on a glass substrate 1 which is made of a transparent material. A very thin transparent N-type conductive film 3 composed of, for example, $CeO_2$ is formed on the upper surface of the transparent electrode 2. A first layer 8 of a P-type photoconductive film consisting of a P-type amorphous semiconductor of a Se-As system containing 5±1% weight of As and the remainder of Se is formed to a thickness of $T_1$=1,000±100 Å on the N-type transparent film 3, and a second layer 9 of the P-type photoconductive film of Se-As-Te system containing 5±1% by weight of As, 30±10% by weight of Te and the remainder of Se, is formed to a thickness $T_2$=1,000±100 Å over the upper surface of the first P-type photoconductive layer 8. A third layer 10 of the P-type photoconductive film of a Se-As system P-type amorphous semiconductor containing Se and As is formed to thickness of $T_3$=1,000±100 Å on the second layer 9 of the P-type photoconductive film, with a concentration distribution in which a concentration of 70±1% by weight of Se and peak concentration of 30±10% by weight of As lying adjacent to the rear of the layer 9 change gradually to 95±1% by weight of Se and 5±1% by weight of As, respectively. A fourth layer 4 is formed on the third layer, containing 95±1% by weight of Se and 5±1% by weight of As to a thickness $T_4$=27,000 Å. A beam landing layer 5 of $Sb_2S_3$ is vapor deposited to a thickness of about 1,000 Å on the layer 11 to be described next. A fifth layer 11 of the P-type photoconductive film of Se-As system containing As of a higher concentration than in the fourth layer 4, is interposed between the fourth layer 4 and the beam landing layer 5 with a thickness of l(Å).

Figure 3:
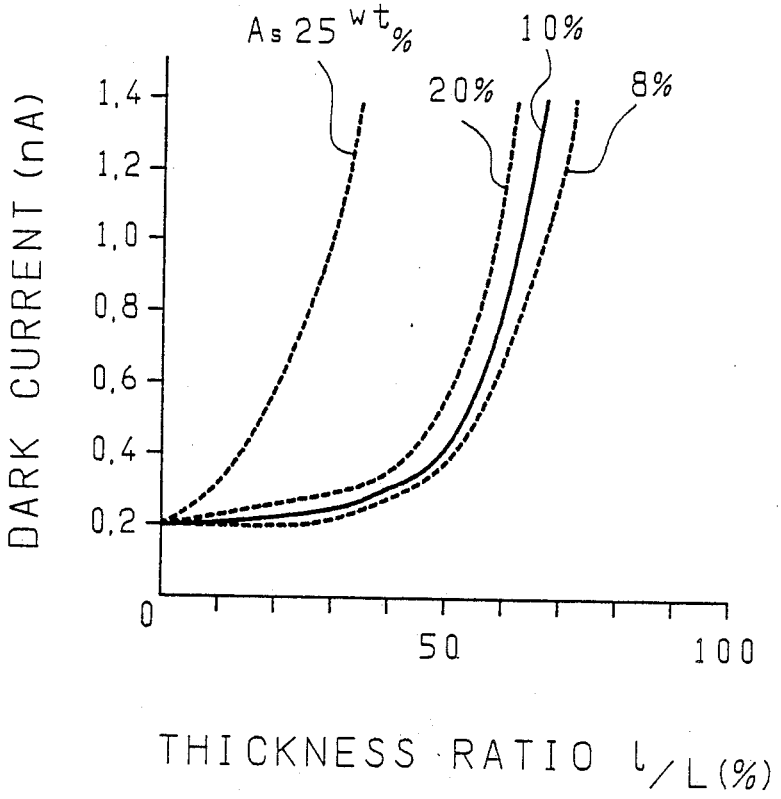
FIG. 3 shows dark current vs. thickness of the fifth layer characteristics in an image pick-up tube incorporating an image pick-up tube target of FIG. 2.

FIG. 3 shows dark current vs. ratio of the thickness of a fifth layer 11, l to the the total thickness of a P-type photoconductive film, L, for different concentrations of As doped in the fifth layer. It was found that dark current can be suppressed to an allowable level if the concentration of doped As is below 20% by weight and the thickness ration l/L is less than 0.5, and that life tests showed little or no variations in signal current-target voltage characteristic occurred after a long term continuous operation of 1000 hours, thermal stability of an image pick-up tube target being ensured if concentration of As doped in the fifth layer is in the range of 8 to 20% by weight and thickness ratio l/L is in the range of 0.05 to 0.5, preferably 0.10 to 0.5. High concentration of As in the fifth layer functions as traps for electrons photogenerated during a long term continuous operation and can extract positive holes generated in the Te-containing layer, that is, the second layer of a P-type photoconductive film towards the beam landing layer of $Sb_2S_3$, thereby improves transport of positive holes through the amorphous Se layers and signal saturation characteristic.

Embodiment

An image pick-up tube target was fabricated as specified below, in FIG. 2, $T_1$=1000 Å, $T_2$=1000 Å, $T_3$=1000 Å, $T_4$=27,000 Å, l=10,000 Å, concentration of Te in the second layer 9 of a P-type photoconductive film is 30% by weight, concentration of As in the first, second, and fourth layers 8, 9, 4 is 5% by weight, peak concentration of As in the third layer 10 is 30% by weight, concentration of As in the fifth layer 11 is 10% by weight, thickness of $Sb_2S_3$=1000 Å, The image pick-up tube target produced 0.3 nA of dark current, and showed little variation in signal current-target voltage characteristic after 1000 hours of operation, and no cracking of the beam landing layer made of $Sb_2S_3$ occurred under high temperature operating conditions.

As has been described in the foregoing, with the image pick-up tube target according to the invention it is possible to prevent variation in photocurrent-voltage characteristic after a long term continuous operation and cracking of a beam landing layer, thus permitting a picked-up image of high quality to be obtained.

What is claimed is:

1. An image pick-up tube target comprising an N-type conductive film formed on a transparent substrate, and a P-type photoconductive film in rectifying contact with said N-type conductive film and comprising a first layer containing As and Se, the average concentration of As in the first layer being below 8% by weight, a second layer containing As, Te and Se, a third layer containing As and Se, the composition of said third layer being different along the direction of thickness thereof, a fourth layer containing As and Se, a fifth layer containing As and Se, the concentration of As being in the range of 8 to 20% by weight and the thickness of said fifth layer being in the range of 5 to 50% of the total thickness of said P-type photoconductive film, in the order named, and a beam landing layer.

2. An image pick-up tube target according to claim 1, wherein the concentration of As in said first, second, and fourth layers is in the range of 2.5 to 6% by weight, the concentration of As in said third layer decreases continuously along the direction of thickness toward said fourth layer.

3. An image pick-up tube target according to claim 2, wherein said beam landing layer is made of $Sb_2S_3$.

4. An image pick-up tube target comprising an N-type conductive film formed on a transparent substrate, and a P-type photoconductive film in rectifying contact with said N-type conductive film and comprising a first layer containing As and Se, the average concentration of As in the first layer being below 8% by weight, a second layer containing As, Te and Se, a third layer containing As and Se, the composition of said third layer being different along the direction of thickness thereof, a fourth layer containing As and Se, a fifth layer containing As and Se, the concentration of As in said fifth layer being larger than that of As in a portion of said fourth layer near a boundary between said fourth layer and said fifth layer and being in the range of 8 to 20% by weight and the thickness of said fifth layer being in the range of 5 to 50% of the total thickness of said P-type photoconductive film, in the order named, and a beam landing layer.

5. An image pick-up tube target according to claim 4, wherein the concentration of As in said first, second, and fourth layers is in the range of 2.5 to 6% by weight, and the concentration of As in said third layer decreases continuously along the direction of thickness toward said fourth layer.

6. An image pick-up tube target according to claim 5, wherein said beam landing layer is made of $Sb_2S_3$.

* * * * *